United States Patent [19]

Waldhofer

[11] 4,295,448

[45] Oct. 20, 1981

[54] GAS GENERATOR FOR FINE-GRAINED COAL FUELS

[75] Inventor: Reinhard Waldhofer, Essen, Fed. Rep. of Germany

[73] Assignee: Krupp-Koppers GmbH, Essen, Fed. Rep. of Germany

[21] Appl. No.: 145,791

[22] Filed: May 1, 1980

[30] Foreign Application Priority Data

May 19, 1979 [DE] Fed. Rep. of Germany ..... 2920372

[51] Int. Cl.[3] ..... F22B 7/18; C10J 3/48

[52] U.S. Cl. ..... 122/164; 122/155 R; 110/184; 110/266; 110/229

[58] Field of Search ..... 122/343, 476, 479 A, 122/164, 155 R; 110/184, 234, 266, 229

[56] References Cited

U.S. PATENT DOCUMENTS

| | | | |
|---|---|---|---|
| 1,948,537 | 2/1934 | Noack | 122/476 |
| 2,815,007 | 12/1957 | Sprague et al. | 122/343 |
| 3,769,923 | 11/1973 | Lawrence | 110/184 |
| 4,191,099 | 3/1980 | Strahl | 110/184 |
| 4,204,463 | 5/1980 | Canty | 110/184 |

FOREIGN PATENT DOCUMENTS 2038445 6/1978 Fed. Rep. of Germany .

*Primary Examiner*—Henry C. Yuen

*Attorney, Agent, or Firm*—Michael J. Striker

[57] ABSTRACT

A gas generator for operation on a fuel of fine-grained coal which includes a steam boiler, a combustion boiler and a stack leading from the combustion. chamber to the steam boiler. The steam boiler is provided with a slanting bottom portion for the discharge of fly ash and slag. The stack from the combustion chamber to the boiler is composed of a gas outlet pipe attached to the combustion chamber and a gas inlet pipe leading to the boiler. The gas outlet and gas inlet pipes are connected by attaching means. The gas inlet pipe has a double wall of which the inner wall with its top extends freely into the slanting bottom portion of the boiler and thus is adapted for axial heat expansion. The outer wall is provided with a heat expansion compensator and is connected with its top end to the said slanting bottom of the boiler and with its bottom end to the connecting means between the gas inlet and gas outlet pipes. The inner wall of the gas inlet pipe may be in the form of a jacket for holding a cooling water.

7 Claims, 3 Drawing Figures

30
29
28
26
27
31
32

GAS GENERATOR FOR FINE-GRAINED COAL FUELS

BACKGROUND OF THE INVENTION

The present invention in its principal aspects involves an improvement of the invention disclosed in German patent No. 20 38 445 of June 15, 1978. In the German patent a gas generator for fuels consisting of coal of a fine grain size has been disclosed which is provided with a combustion chamber and a steam boiler arranged vertically above the combustion chamber. A combustion shaft leads from the combustion chamber to the boiler and is arranged with an excentricity relative to the vertical axis of the boiler. The boiler itself has a slanting bottom for entrained fly ash, slat, etc. The slanted bottom has a terminal discharge device for the fly ash, etc.

The combustion shaft extending to the boiler ends and opens up into the slanting bottom surface of the boiler. The boiler itself and likewise its slanting bottom surface and also the combustion shaft and likewise a discharge shaft leading from the combustion chamber are all provided with boiler pipes.

This structure is fairly complex and requires rather expensive wall construction for housing and forming the boiler pipes. It is in particular necessary to have a heat expansion compensator device in connection with the combustion shaft between the combustion chamber and the slanting bottom surface of the boiler. Preferably, this compensator device should be arranged at the point where the gas inlet pipe forming part of the combustion shaft and the gas outlet shaft from the combustion chamber which also is part of the combustion shaft are interconnected. For this purpose a heat resistant fiber material can be used. This, however, involves the risk of penetration of fly ash and this in turn may interfere with the proper operation of the compensator device.

The present invention therefore has the object to improve the structure of the combustion shaft which, as indicated, is composed of the gas inlet to the boiler and the gas exit from the combustion chamber. Such a shaft should be of a simpler construction which is less expensive and in particular the grooves formed by the boiler pipes within the combustion shaft should be avoided.

ESSENCE OF THE INVENTION

To solve this object the gas inlet pipe leading to the boiler which is connected to the gas outlet pipe from the combustion chamber is provided with a double wall. The inner wall portion is arranged for axial movement by freely penetrating into the slanting bottom of the steam boiler. The outer wall portion is provided with a compensator and is attached on one end to the slanting bottom and on the other hand in the area of the connection between the gas inlet and gas outlet pipe.

This structure permits to provide the combustion shaft at its inside with entirely smooth walls while the gas inlet pipe and gas outlet pipe are rigidly connected by means of a flange connection. In case of heat expansion the inner wall of the gas inlet pipe can freely expand into the boiler. It will be understood that a suitable gasket device must be provided between this inner wall and the bottom wall of the waste-heat boiler. To equalize any heat expansion the exteriorily arranged compensator is provided which thus is not in contact with the gas current passing through the combustion shaft.

In another embodiment of the invention it is proposed to form the inner wall of the gas inlet pipe as a water-cooled jacket. However, it is also possible to form this inner wall as a ceramic structure. In both cases a comparatively inexpensive design can be realized.

A further saving in designing the structure of the gas generator can be obtained by providing for a ceramic cladding of the ash funnel provided at the end of the slanting bottom of the boiler. Also, the slanting bottom itself and the boiler portion surrounding it may be provided with a ceramic cladding.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILS OF THE INVENTION AND EMBODIMENTS

Figure 1:
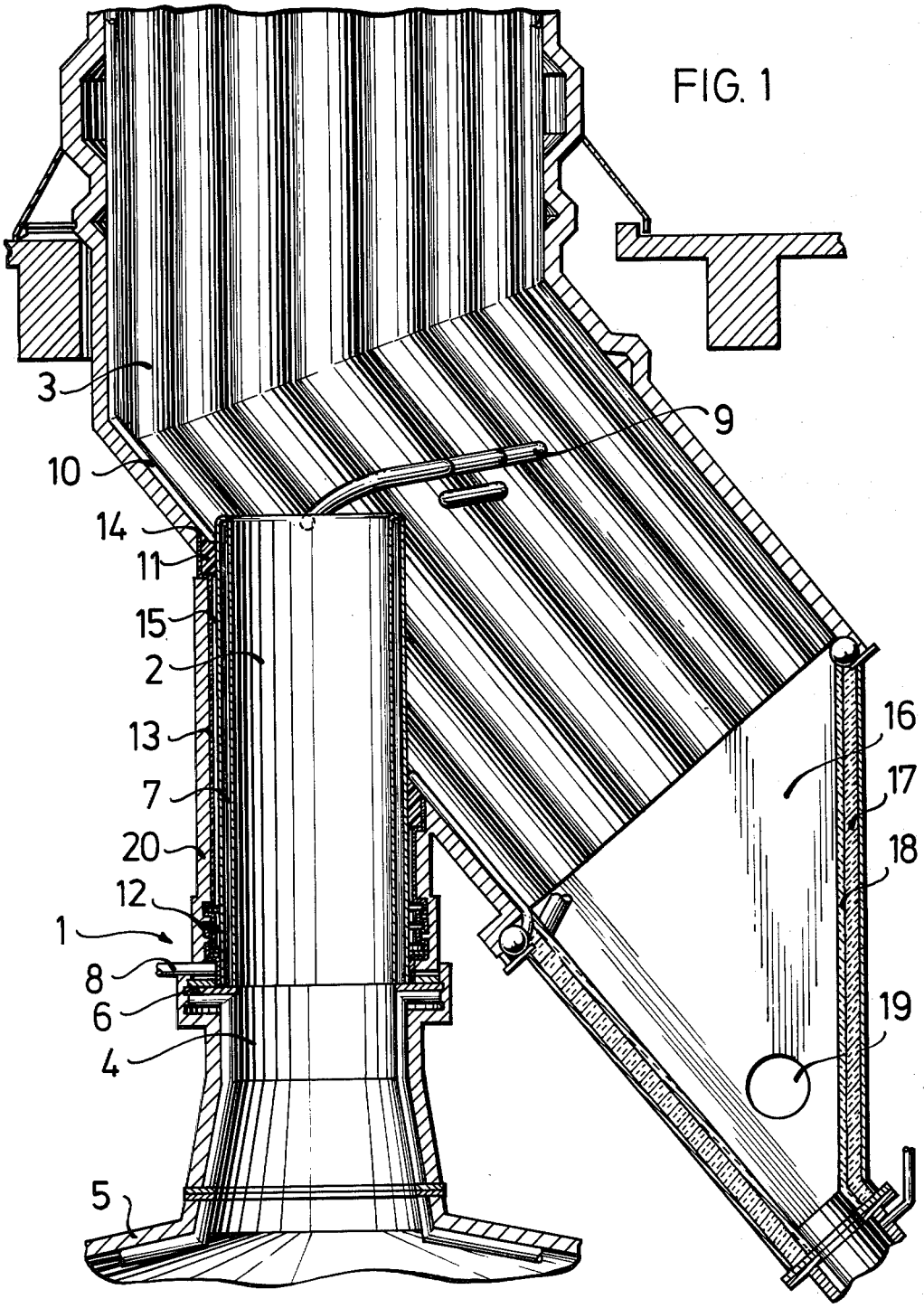
FIG. 1 illustrates a vertical section through the combustion chamber shaft and the lower area of the steam boiler. In this embodiment the inner wall of the gas inlet pipe leading to the boiler is in the form of a cooling water containing jacket.

With reference to FIG. 1 it will be seen that numeral 1 is the general reference to the combustion chamber shaft. The shaft is composed of the gas inlet pipe 2 which connects with the boiler 3 and the gas outlet pipe 4 which is attached to the combustion chamber 5. Only the lower portions of the steam boiler are shown. Gas inlet and gas outlet pipes are rigidly connected by means of the flange 6. The inner wall of the combustion shaft in this area as will be seen has smooth walls without protruding or recessed portions.

According to the invention the gas inlet pipe 2 is provided with a double wall. In the embodiment of FIG. 1 the inner wall consists of a jacket 7 containing a cooling water. The water inlet is shown at 8 and the water outlet is arranged through the compensator pipe snake 9. The latter can of course be also replaced by any other kind of pipe type.

The water cooled jacket 7 extends freely into the slanting bottom 10 of the steam boiler and therefore is adapted for axial movement into the slanting bottom in case of heat expansion. A suitable seal 11 is provided between the slanting bottom and the water cooled inner wall 7.

The inner wall is surrounded by an outer wall 13 which is provided with a compensator 12. The lower end of the outer wall is connected with the inner wall in the area of the flange connection 6. The upper end is attached to the slanting bottom of the boiler at 14. The space 15 between the inner and the outer wall may be charged with an inert gas through an inlet duct, not shown in the drawing. The outer wall is provided with an insulating outer coating 20.

The slanting bottom 10 is formed with boiler pipes in the same manner as the adjoining portions of the boiler. The connecting ash funnel 16 which leads to a discharge device, not shown in the drawing, however, is provided with a damping clay mass 17 and a ceramic coat 18 disposed thereon. The numeral 19 indicates a manhole in the ash funnel.

Figure 2:
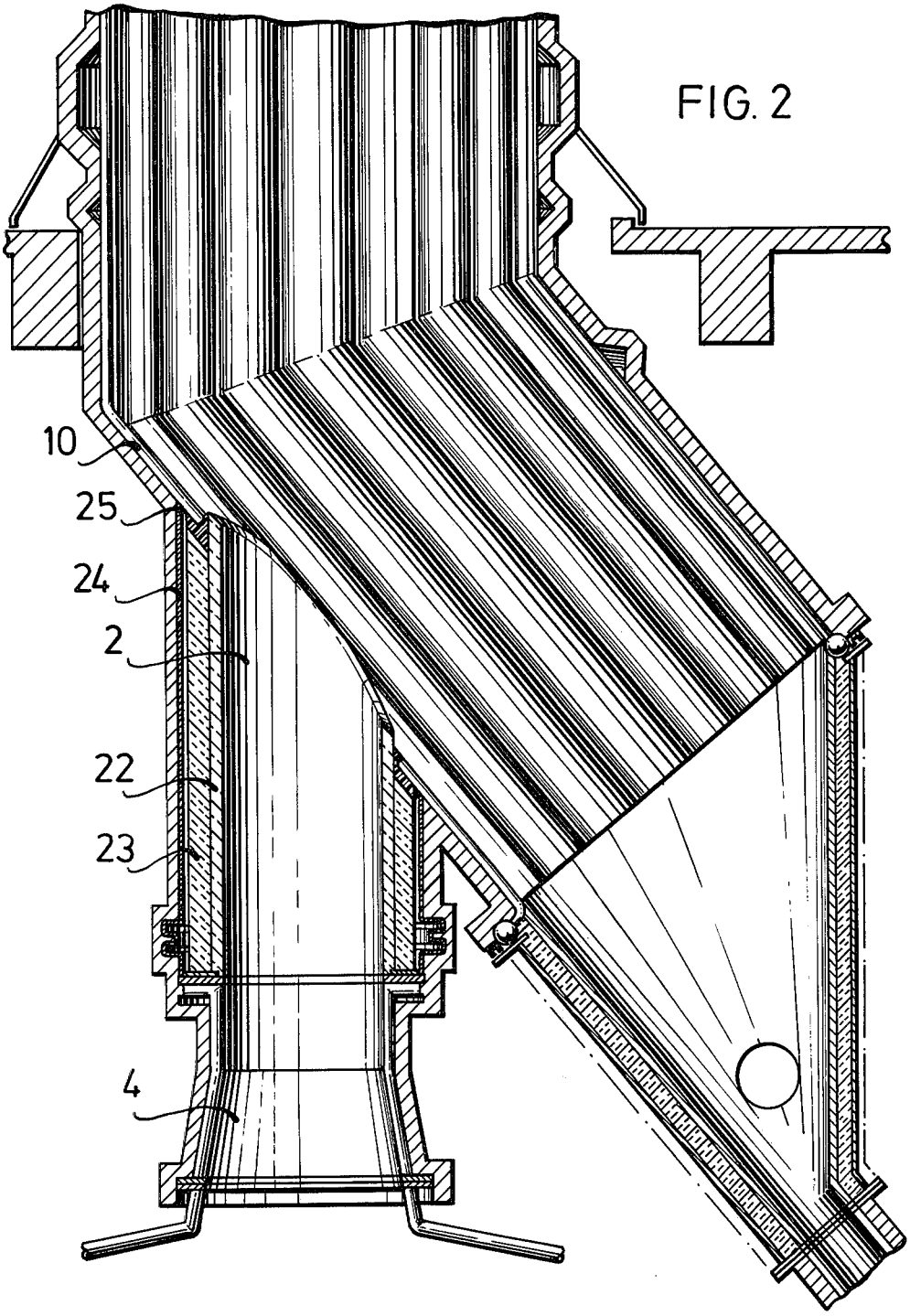
FIG. 2 is a section similar to that of FIG. 1 which, however, shows a ceramic structure of the inner portion of the gas inlet pipe.

With reference now to FIG. 2 it will be seen that the only distinction here is that instead of the water cooled inner wall of the gas inlet pipe there is provided an inner structure 22 made of a fireproof and wear-resistant ceramic material. However, in this case also the inner wall can move through the opening in the slanting bottom of the boiler. At its outside the inner wall 22 is provided with an insulating material 23. The outer wall 24 is in this case in the form of a cylinder extending up to the bottom portion of the boiler.

Figure 3:
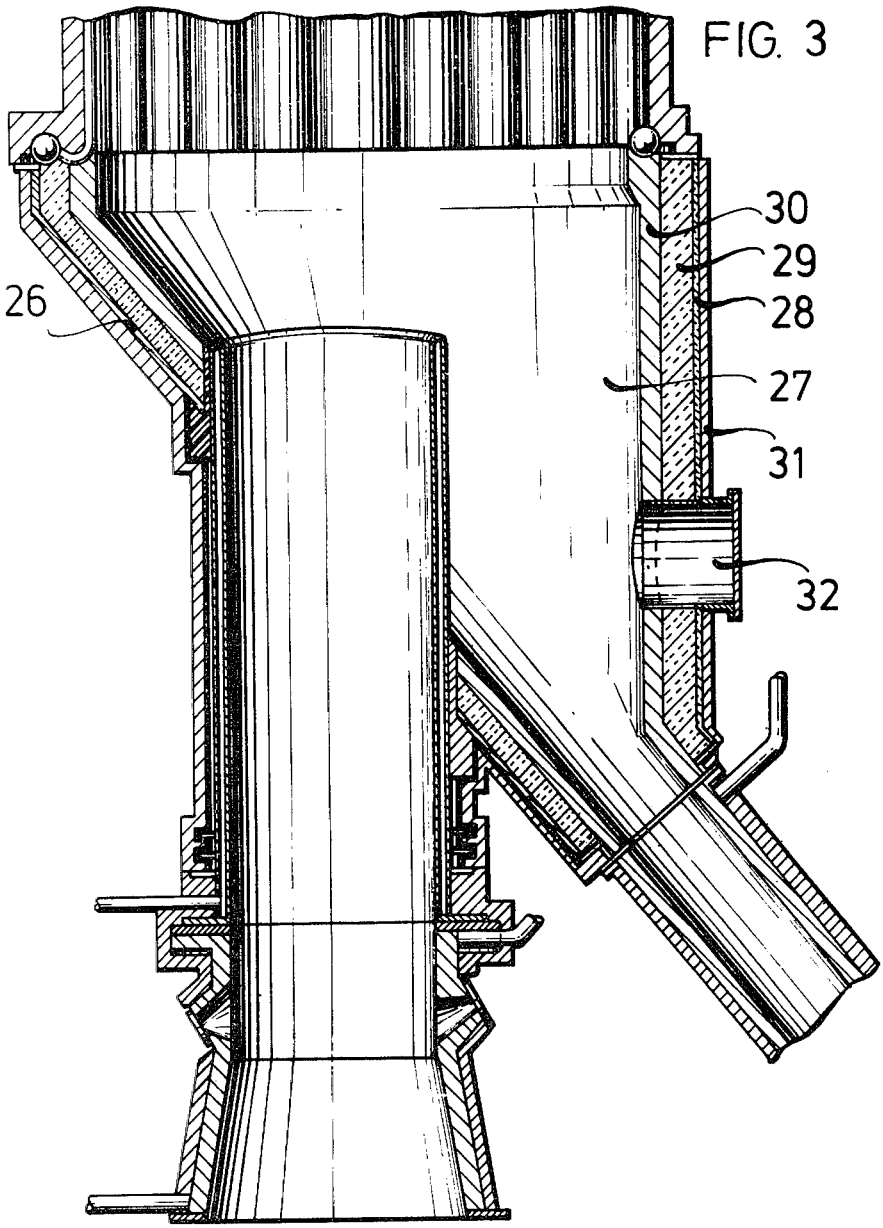
FIG. 3 is again a section as in FIG. 1 which, however, illustrates an embodiment where the slanting bottom and the surrounding portions of the boiler are provided with a ceramic cladding.

Referring then to FIG. 3 it will be seen that the slanting bottom 26 as well as the lower portion of the slanting part of the boiler are formed as an ash discharge funnel 27. This funnel portion is provided at its inside with an insulating mat 28, an insulating coat 29, and a fireproof and wear-resistant material 30 (going in the direction from the outside to the inside). The outer insulation and the protection against contact is indicated as 31, while 32 designates the manhole.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gas generator for operation on a fuel of fine grained coal, the said generator comprising a steam boiler, a combustion chamber, a stack leading from the combustion chamber to the steam boiler, a slanting bottom portion forming the lower part of the steam boiler for the discharge of flue ash and slag, a gas outlet pipe attached to the combustion chamber and forming the lower part of said stack, a gas inlet pipe leading to the boiler and forming the upper part of said stack, connecting means attaching the gas inlet pipe to the said gas outlet pipe, the said gas inlet pipe having a double wall of which the inner wall with its top extends freely into said slanting bottom portion of the boiler and thus is adapted for axial movement due to heat expansion, and the outer wall being provided with a heat expansion compensator and being connected with its top end to the said slanting bottom portion of the boiler and being attached with its bottom end to the said connecting means between said gas inlet and gas outlet pipes.

2. The gas generator of claim 1, wherein the said inner wall of the gas inlet pipe is constituted by a jacket for holding cooling water, the jacket being provided with a water inlet and a water outlet.

3. The gas generator of claim 1, wherein the inner wall constitutes a ceramic structure.

4. The gas generator of claim 1 wherein the slanting bottom portion of the boiler extends into a discharge funnel for the fly ash and slag, the said funnel having a ceramic cladding.

5. The gas generator of claim 1 wherein the slanting bottom and the surrounding boiler portions are provided with a ceramic cladding.

6. The gas generator of claim 1 wherein the space between said inner wall and said outer wall of the gas inlet pipe is adapted to be filled with an inert gas.

7. The gas generator of claim 1 wherein the boiler is provided with internal boiler pipes and the said stack and the said bottom portion of the boiler having substantially smooth walls free of boiler pipes.

* * * * *